United States Patent [19]

Rover

[11] 4,083,024

[45] Apr. 4, 1978

[54] MINIATURE RELAY

[75] Inventor: Jack T. Rover, Boring, Oreg.

[73] Assignee: Datron Systems, Inc., Thomaston, Conn.

[21] Appl. No.: 730,338

[22] Filed: Oct. 7, 1976

[51] Int. Cl.[2] ..... H01H 51/02

[52] U.S. Cl. ..... 335/136; 335/106; 335/268

[58] Field of Search ..... 335/106, 128, 187, 125, 335/136, 266, 276, 268, 267, 272, 228

[56] References Cited

U.S. PATENT DOCUMENTS

| | | | |
|---|---|---|---|
| 2,827,528 | 3/1958 | Girdwood et al. | 335/272 |
| 2,872,627 | 3/1959 | Buchtenkirch | 335/228 |
| 2,987,657 | 6/1961 | Buchtenkirch et al. | 335/228 |
| 3,092,700 | 6/1963 | Cohen | 335/125 |
| 3,109,903 | 11/1963 | Lychyk | 335/125 |
| 3,201,661 | 8/1965 | Koutnik | 335/267 |
| 3,234,436 | 2/1966 | Bieger | 335/268 |
| 3,273,087 | 9/1966 | Huckabee | 335/128 |
| 3,274,523 | 9/1966 | Bayer et al. | 335/128 |
| 3,394,325 | 7/1968 | Zimmer | 335/266 |
| 3,821,673 | 6/1974 | Daugherty et al. | 335/268 |

*Primary Examiner*—Harold Broome
*Attorney, Agent, or Firm*—Klarquist, Sparkman, Campbell, Leigh, Hall & Whinston

[57] ABSTRACT

A miniature relay having a large number of contacts is housed in a dual in-line plug compatible with integrated circuitry and the like. A pair of operating coils are disposed upon a central cylindrical core upon which an armature turns, said armature being positioned between the two operating coils. The coils generate a magnetic flux in opposite directions through the core which flux combines in the armature for rotating the armature against a frame in magnetic circuit with the core.

8 Claims, 8 Drawing Figures

FIG. 1
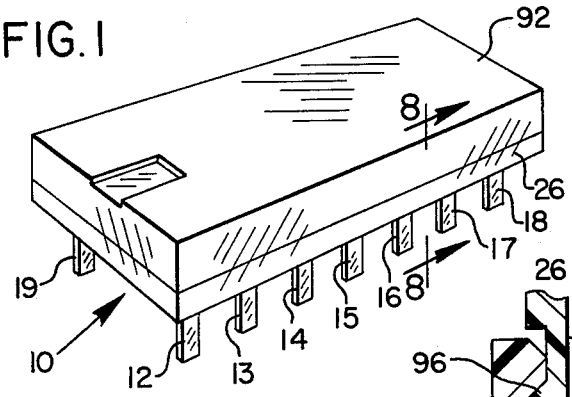
FIG. 2
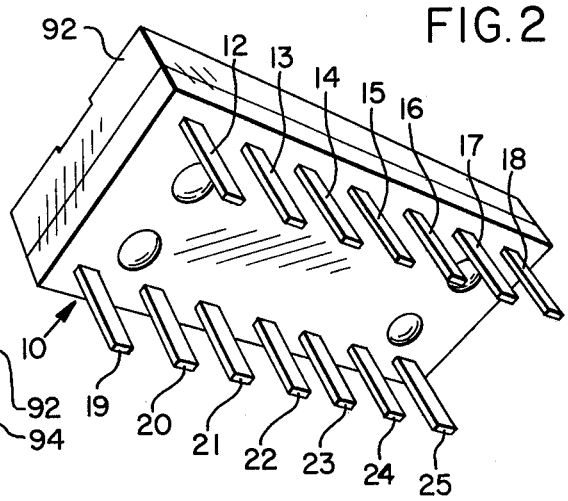
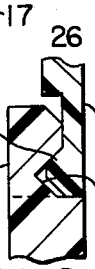
FIG. 3
FIG. 8
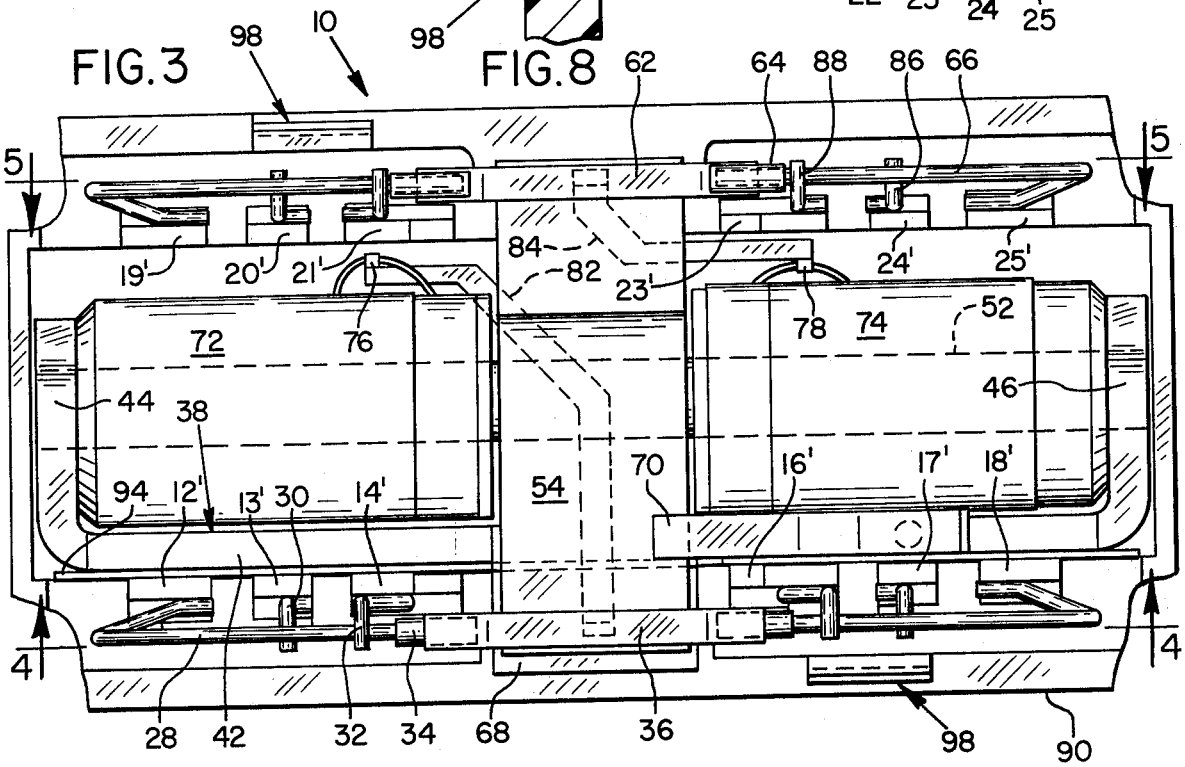
FIG. 4
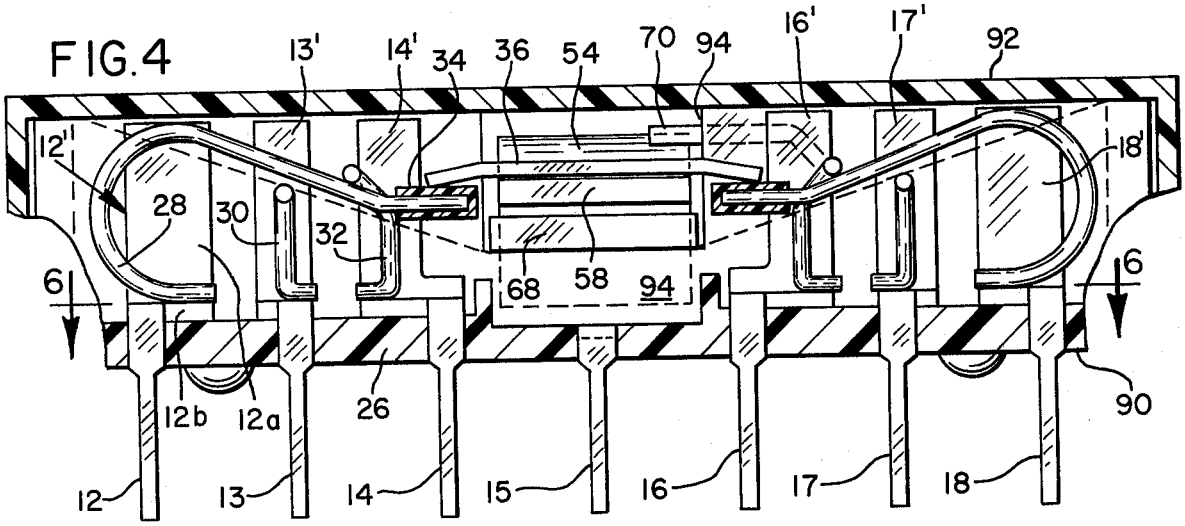

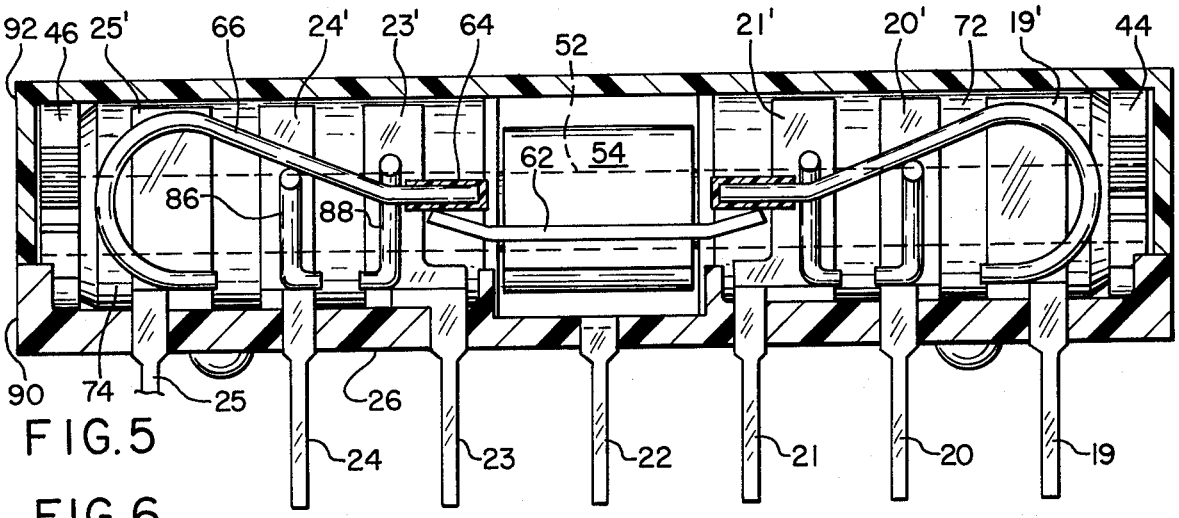
FIG.5
FIG.6
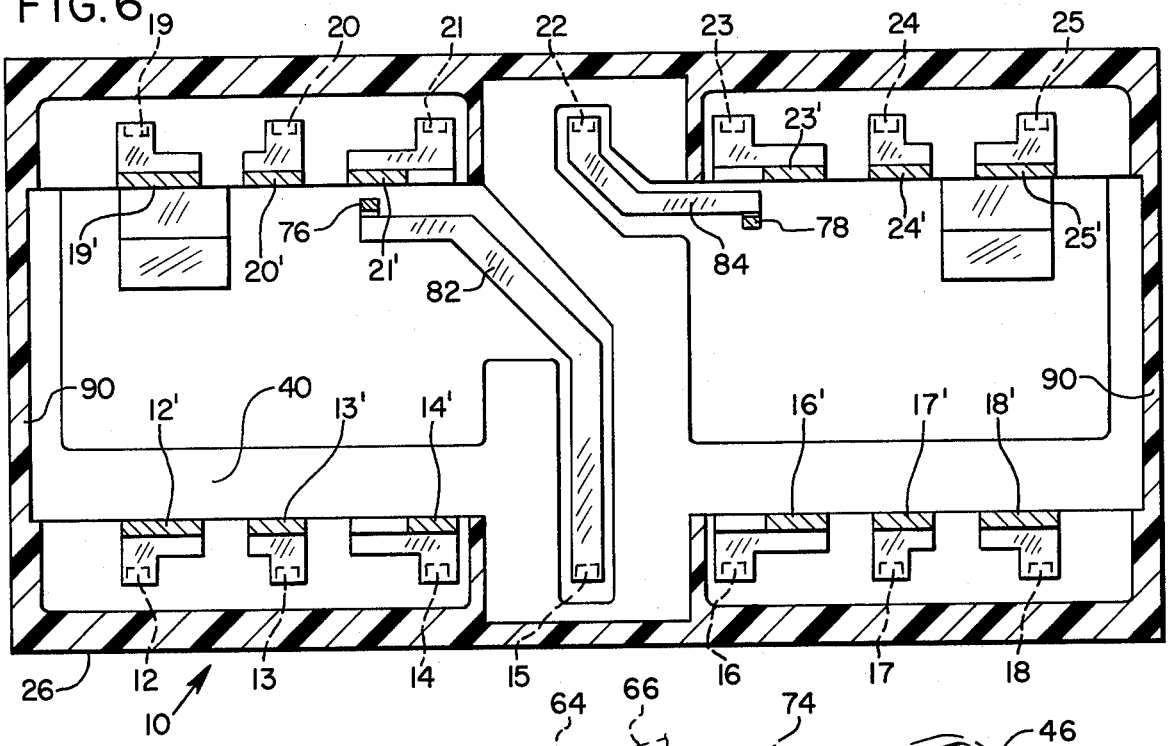
FIG.7
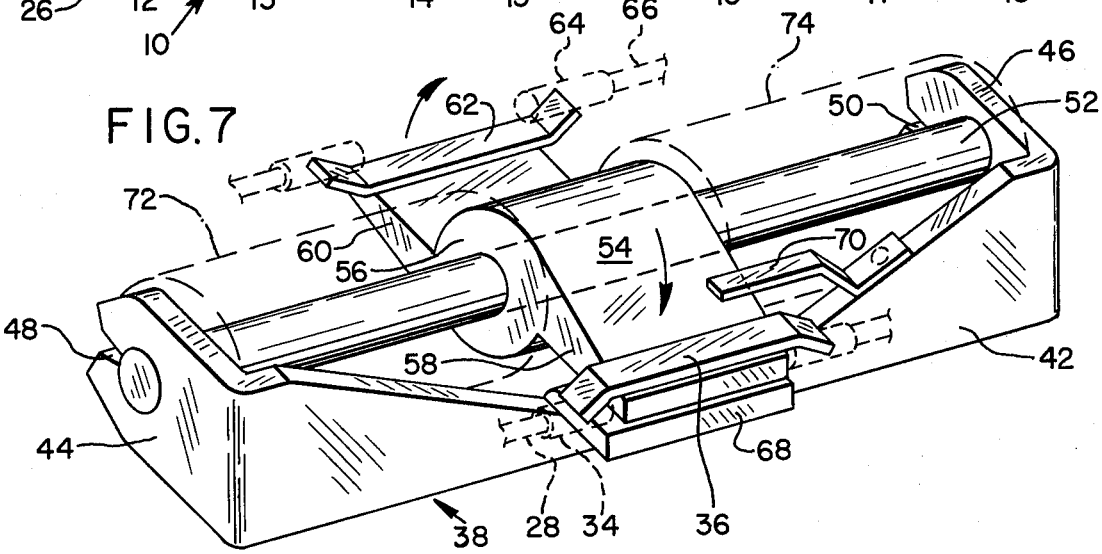

MINIATURE RELAY

BACKGROUND OF THE INVENTION

The present invention relates to relays and particularly to miniature electro-mechanical relays.

In miniaturized integrated circuit configurations such as employed for electronic digital circuits, interfacing with mechanical switching contacts is frequently desirable, e.g., for operating peripheral equipment or servomechanism devices. A common type of switching element employed with integrated circuit devices comprises a reed relay including a pair of reed contacts mounted in a small glass envelope upon which an operating coil is wound for causing mutual attraction of the reed contacts. Because of their small size, reed relays are adaptable to the space limitations of the integrated circuit environment and a number of such reed relays can be conveniently mounted on an integrated circuit plug for connection to the circuitry. However, reed relays are comparatively expensive and the power handling capability thereof is limited. Of course, larger electro-mechanical relays can be employed, but usually require special consideration in regard to the space needed and the clearance required above a panel board.

SUMMARY OF THE INVENTION

According to the present invention, a miniature electro-mechanical relay having a plurality of contacts is accommodated in a small space. A frame supports a core around which a pair of actuating coils are disposed, with a rotatable armature being positioned between the coils and energizable thereby for rotation toward the frame. The coils provide flux in opposite directions through the core and in the same direction through the armature so that the fluxes thereof add in the armature.

The relay according to the present invention is advantageously accommodated in a small integrated circuit plug of the type adapted for housing integrated circuit semi-conductor devices.

It is accordingly an object of the present invention to provide an improved miniature relay adapted for utilization in connection with miniaturized integrated circuit apparatus.

It is another object of the present invention to provide an improved miniature electro-mechanical relay of optimum performance and power handling capability.

It is a further object of the present invention to provide an improved miniature electromechanical relay for operating a large number of contacts in a minimum space.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a perspective view of a relay according to the present invention as housed in a miniature plug.

FIG. 2 is a perspective underside view of the FIG. 1 plug.

FIG. 3 is a top view, partially cut away, of the relay according to the present invention with a plug cover removed.

FIG. 4 is a partially cut away, cross-sectional view taken at 4—4, FIG. 3.

FIG. 5 is a cross-sectional view taken at 5—5, FIG. 3.

FIG. 6 is a horizontal, cross-sectional view of the plug base taken at 6—6 at FIG. 4.

FIG. 7 is a perspective view of the actuator portion of the relay according to the invention, and FIG. 8 is a detailed view of a catch mechanism for holding a cover on the plug base for the relay according to the present invention.

DETAILED DESCRIPTION

Referring to the drawings and particularly to FIGS. 1–6 illustrating a miniature relay according to the present invention, said relay includes a miniature dual in-line plug 10 as adapted for use with plugs of a similar type employed for integrated circuits and supported on a common panel board. The plug 10 is provided with first and second rows of connecting pins 12–18 and 19–25 of conductive metal which are molded into the plastic base 26 of the dual in-line plug so as to protrude perpendicularly therefrom for reception by a matching circuit board (not shown). The pins 12–14, 16–18, 19–21 and 23–25 are integrally formed with L-shaped metal terminals 12'–14', 16'–18', 19'–21' and 23'–25', respectively. These terminals are upstanding from base 26 with the lower part of the L-shape being joined to a respective connecting pin. Thus, for example, terminal 12' includes a flat vertical portion **12*a* extending vertically upwardly from the plug and parallel to the longer sides of the plug. Portion 12*a* is supported by horizontal base portion 12*b* joined at its outer edge to connecting pin 12. A wire contact 28 is joined to terminal 12' at the interior corner of the L-shape as by soldering or welding. Wire contacts 30 and 32 are similarly joined to terminals 13' and 14'**, while each of the other three sets of terminals supports a similar set of wire contacts.

In the set of contacts 28, 30, 32, movable contact 28 is normally closed against the horizontal extension of contact 32, but when operated contact 28 breaks the circuit with contact 32 and makes connection with the horizontal extension of contact 30. Movable contact 28 is arcuately formed providing a spring-like bias action and extends in a semi-circle from the base portion **12*b* of terminal 12' towards the top of said terminal, and from there downwardly between the horizontal extension of contacts 30 and 32. Contact 28 is also flared outwardly away from terminal 12' above base portion 12*b* for passing between the contacts 30 and 32 in spaced relation to terminals 13' and 14'**.

Normally closed contact 32 extends upwardly along terminal 14' from the base thereof and is then bent in a horizontal manner to receive contact 28 in spring biased relation thereagainst. Similarly, contact 30 proceeds upwardly along terminal 13' and is then bent outwardly in a horizontal manner underneath and normally in spaced relation with contact 28. The end of contact 28 remote from terminal 12' receives a sleeve 34 of insulating material against which an acutator 36 bears for forcing contact 28 away from contact 32 and toward contact 30. Each of the contacts is formed of self-supporting, solid, conductive wire having sufficient spring biasing characteristics for enabling the hereinbefore described contact operation. The other sets of contacts associated with terminals 16'–18', 19'–21' and 23'–25' are substantially similar and will not be described in great detail. It will be seen that each of the four sets of contacts provides single pole, double throw operation.

The four sets of three terminals, and the contacts they support, are disposed in two rows above the respective connecting pins along the longer side edges of the plug, while therebetween is positioned an actuator mechanism for simultaneously operating the separate contacts. The actuator mechanism comprises a U-shaped frame 38 formed of magnetically permeable material mounted on its side upon a central raised boss 40 in base 26. Frame 38 includes elongated end member 42 extending lengthways of the plug, and two side extensions 44 and 46 disposed across the plug at either end of member 42. The side extensions are provided with end slots, 48 and 50 respectively (see FIG. 7), into which are received ends of cylindrical core 52, also formed of magnetically permeable material. This core is located in central axial position of a plug. In manufacture of the device, the core 52 is assembled into the slots 48 and 50, after which extensions 44 and 46 are crimped together for firmly engaging the ends of the core. An insulating wall 94, for example, formed of Kapton polyimide film, is suitably disposed between terminals 12',13',14',16',17' and 18', and the end 42 of frame 38.

Centrally of the cylindrical core, is located a balanced armature 54 which is also formed of a magnetically permeable material. The armature includes a hub 56 journaled on core 52 for rotation with respect to said core. The hub 56 is comparatively wide, e.g., having a dimension along the core nearly one-fifth of the core length for assuring an adequate magnetic circuit between the core and the armature. The armature further includes first and second arms 58 and 60 which have approximately the same dimension as hub 56 along the core, and which extend tangentially outwardly from opposite sides of the hub toward and between the four sets of contacts disposed along the sides of the plug. The forward arm 58 has secured to its upper surface the aforementioned actuator 36 for engaging insulating sleeves which operate the contacts, for example sleeve 34 on contact 28. The respective ends of actuator 36 are bent downwardly for engaging the insulating sleeves in the proper position. While actuator 36 is secured to the top of armature arm 58 and the ends thereof are bent downwardly, the ends of actuator 62 secured to arm 60 are bent upwardly for engaging similar sleeves, for example sleeve 64 on the end of movable contact 66. In either case, centrally disposed movable wire contacts are engaged.

End portion 42 of frame 38 is of the same height as extensions 44 and 46 where it joins the same, but gradually reduces in its vertical dimension toward the center of the relay providing a V-shaped configuration such that armature arm 58 extends through the V. (See FIG. 7.) At the bottom of the V, the frame end 42 extends outwardly to provide a ledge or shelf 68 in juxtaposition with the underside of arm 58 providing a pole piece. The frame end 42 has attached thereto a backstop 70 extending above arm 58 and normally locating the arm within a few thousandths of an inch from shelf 68 providing a small air gap in the magnetic circuit. The armature arm is normally biased against stop 70 by the biasing action of the movable wire contacts, for example, contact 28. The movement of the armature between stop 70 and shelf 68 opens the normally closed contacts while closing the normally open contacts to complete the switching function of the relay. At each side of armature 54 and around core 52 are disposed operating coils 72 and 74 which establish magnetic flux in the core and frame for actuation of the armature. These coils are of equal size, and center the armature 54 on the core 52. The coils are connected in parallel to terminals 76 and 78 which in turn are connected to pins 15 and 22 by way of conductive metal strips 82 and 84 running along recessed portions of the base 26. Pins 15 and 22 are connectable to a source of power for energizing the relay. These coils are connected to provide flux in opposite directions lengthways of core 52, and in the same direction through arms 58 and 60 of armature 54. Thus, the flux from the two coils adds an armature 54 by way of a first magnetic circuit including the core within the coil 72, extension 44 and the left end of frame end 42 (as viewed in FIG. 7) on the one hand, and a second magnetic circuit including the core within coil 74, extension 46 and the right hand side of frame 42. The coils 72 and 74 are balanced to prevent a net longitudinal flux therebetween. This configuration concentrates the flux of the two coils in armature 54 while making optimum use of the elongated space in the dual in-line plug. At the same time, the configuration is balanced and provides the four sets of double throw contacts in an extremely small space. The dual in-line plug is typically about a half an inch wide by eight-tenths of an inch long by three-tenths of an inch high.

Further considering the contacts as operated by the relay, and with particular reference to FIG. 5, it will be seen that movable contacts on this opposite side of the relay move upwardly as actuator 62 attached to armature 54 moves upwardly. For example, movable wire contact 66 normally makes connection with the horizontal extension of contact 86, but when operated by actuator 62, the movable contact 66 breaks with contact 86 and makes connection with the horizontal portion of contact 88. Contacts 66, 86 and 88 are joined to terminals 25', 24' and 23' in the same manner as hereinbefore described.

The base 26 is provided with a circumferential upwardly extending flange 90 upon which plastic cover 92 is suitably secured. FIG. 8 illustrates in detail a catch mechanism 98 for holding cover 92 onto flange 90. Flange 90 on either side of a plug includes an upstanding catch including the V-shaped groove 94 for receiving a similarly shaped protrusion 96 in the side of cover 92. Cover 92 is indented above protrusion 96 for accommodating the protruding portion of catch above groove 94.

The construction herein disclosed provides a relay in a very minimum space having the advantages of an electro-mechanical relay wherein greater mechanical force is exerted for the switching of greater power in a given space than could be accomplished in a typical reed relay construction. A greater continued force is applied to the contacts in their closed or operated condition and a high break force can be achieved. Likewise, a suitable biasing force can be achieved. Likewise, a suitable biasing force can be utilized for the relay contacts in their self-biased or normal condition. Consequently, more current can be carried by these contacts in either the self-biased position or in the relay actuated position.

While I have shown and described a principal embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A miniature relay comprising:

a pair of actuating coils each provided with magnetically permeable core means, a rotatable armature formed of magnetically permeable material and positioned between first ends of said core means to form a magnetic circuit therewith, said armature being rotatable about a fixed axis joining said first ends of said core means and including a hub contiguous with said first ends of said core means forming a magnetic extension thereof, a magnetically permeable frame disposed between second ends of said core means and providing a pole piece, said armature including an arm portion joined to said hub and extending adjacent said pole piece to be attracted by said pole piece for rotating said armature when said operating coils are energized, means for energizing said actuating coils to provide magnetic flux through said core means and said frame in opposite directions for additively combining between said armature and said pole piece, and contact means operated by said armature.

2. A miniature relay comprising:

a pair of actuating coils each provided with magnetically permeable core means, a rotatable armature formed of magnetically permeable material and positioned between first ends of said core means to form a magnetic circuit therewith, said coils and said core means being aligned with the core means extending through said armature to form a common shaft upon which said armature rotates, a magnetically permeable frame disposed between second ends of said core means and providing a pole piece adjacent said armature and to which said armature is attracted when said operating coils are energized, means for energizing said actuating coils to provide magnetic flux through said core means and said frame in opposite directions for additively combining between said armature and said pole piece, and contact means operated by said armature, said frame being disposed in close spaced parallel relation to said common shaft and including an abutment adjacent said armature for forming said pole piece, said armature including an arm extending outwardly perpendicular to said shaft and into juxtaposition with said abutment.

3. The relay according to claim 2 wherein said contact means are adjacent said frame and are actuated by said arm.

4. The relay according to claim 3 wherein said armature further includes a diametrically oppositely extending second arm and further contact means operated by said second arm.

5. A miniature relay comprising:

a dual in-line plug adapted to be received upon a circuit board for supporting miniaturized circuit components, said plug including a base formed of insulating material having two adjacent rows of terminals molded into said base providing electrical connections at the top of said base from said circuit board therebeneath, a magnetically permeable frame supported by said base and extending substantially the length of said base, a cylindrical magnetic core disposed centrally along the length of said base, and means at either end of said magnetic core for completing a magnetic circuit between said core and said frame, a pair of actuating coils disposed on said core, a rotatable armature formed of magnetically permeable material positioned on said core between said coils and rotatable with respect to said core, said armature having an arm in juxtaposition with a central portion of said frame, means for energizing said coils to provide flux in opposite directions through said core and in a common direction through said armature for attracting the arm of said armature toward said frame.

and contacts operable by the arm of said armature.

6. A miniature relay comprising:

a pair of actuating coils each provided with magnetically permeable core means, a rotatable armature formed of magnetically permeable material and positioned between first ends of said core means to form a magnetic circuit therewith, said coils and said core means being aligned with the core means extending through said armature to form a common shaft for said armature, a magnetically permeable frame disposed between second ends of said core means and providing a pole piece adjacent said armature and to which said armature is attracted when said operating coils are energized, means for energizing said actuating coils to provide magnetic flux through said core means and said frame in opposite directions for additively combining between said armature and said pole piece, and contact means operated by said armature, said frame being disposed in close spaced parallel relation to said common shaft and including an abutment adjacent said armature for forming said pole piece, said armature including an arm extending outwardly perpendicular to said shaft and into juxtaposition with said abutment.

7. The relay according to claim 6 wherein said contact means are adjacent said frame and are actuated by said arm.

8. The relay according to claim 7 wherein said armature further includes a diametrically oppositely extending second arm and further contact means operated by said second arm.

* * * * *